United States Patent [19]

Summers

[11] 4,015,853

[45] Apr. 5, 1977

[54] BABY WALKER ENCLOSURE

[76] Inventor: Cherry Sue Summers, 4133 Cherokee Trail, Fort Worth, Tex. 76133

[22] Filed: Aug. 25, 1975

[21] Appl. No.: 607,104

[52] U.S. Cl. ..... 280/87.02 W

[51] Int. Cl.[2] ..... B62B 7/00

[58] Field of Search ..... 280/87.01, 87.02 R, 280/87.02 W; 296/102, 28 R; 272/1 R, 70, 70.3, 70.4; D12/130

[56] References Cited

UNITED STATES PATENTS

| | | | |
|---|---|---|---|
| 3,137,501 | 6/1964 | Cirami | 272/1 R |
| 3,183,028 | 5/1965 | Williams | 272/70.3 X |

*Primary Examiner*—Robert R. Song
*Assistant Examiner*—R. Schrecengost

[57] ABSTRACT

Disclosed herein is an enclosure to be attached to a baby walker of the type having a frame with a seat for the child, the walker being mounted on castors. The enclosure extends over and surrounds the child to prevent the child from reaching objects. The enclosure is formed of ribs of flexible plastic intersecting each other. Apertures between the intersections allow the passage of air and light, but are small enough to prevent the child from reaching through.

9 Claims, 2 Drawing Figures

BABY WALKER ENCLOSURE

BACKGROUND OF THE INVENTION

1. Field of the Invention

This invention relates to baby walkers in general and in particular to an enclosure for a baby walker.

2. Description of the Prior Art

Baby walkers are old in the art. Generally they contain a frame mounted on castors, with a seat in the center. The seat is low enough so that the child may stand and walk about a room, rolling the walker with him and being prevented from falling by it.

A problem associated with these baby walkers is that the child is able to reach objects on tables and chairs, which may be harmful or may fall on him. Some walkers have a fairly wide bumper which may be wider than a child's reaching ability. However, this is no aid for overhanging furniture and the size makes manuevering difficult. Also other children, capable of walking, may hand objects to the child which might be harmful.

SUMMARY OF THE INVENTION

It is accordingly an object of this invention to provide an improvement to baby walkers which will prevent the child from being able to reach objects, yet maneuver the walker with ease.

In accordance with this object, an enclosure is provided to fit over and fasten to the frame of the walker. The enclosure is made of a plurality of intersecting ribs, spaced apart with apertures for viewing.

DESCRIPTION OF THE PREFERRED EMBODIMENT

Figure 1:
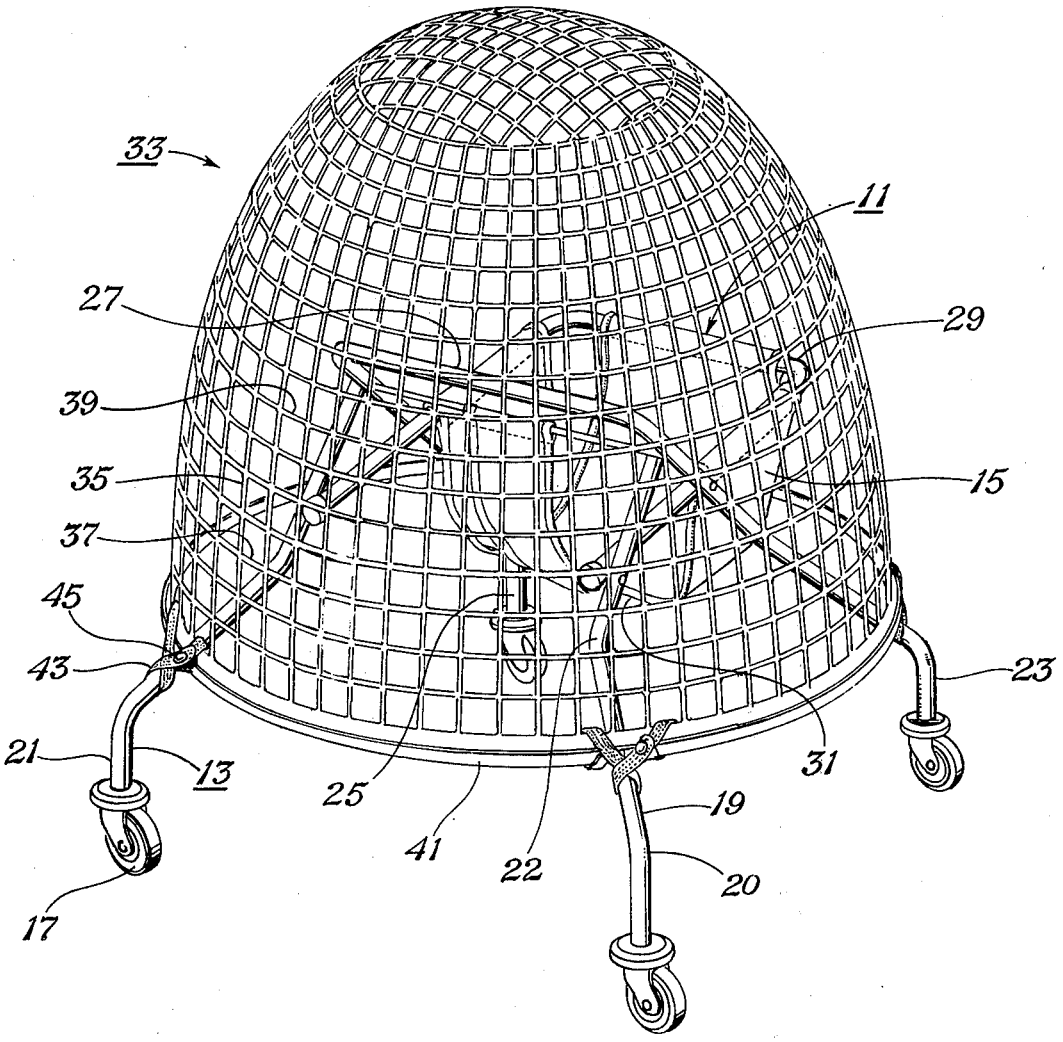
FIG. 1 is a perspective view of the enclosure mounted on a typical baby walker in accordance with this invention.

In reference to the drawing, the baby walker 11 shown is of a conventional type. It is comprised of a tubular metal frame 13 that supports a seat 15 for a child. The frame 13 is mounted on castors 17 for allowing the child to roll the walker with him as he walks.

The frame 13 in the preferred embodiment has four legs 19, 21, 23 and 25, each having a castor 17 mounted to its bottom end. Each leg is bent inward as at 20 then upward as at 22 to form the support for the seat. The castors are spaced apart from each other sufficiently to be stable.

The two rear legs 23, 25 are formed of a single metal tube bent in the center to form a straight handle 27 for gripping by the child. The two front legs 19, 21 are affixed to the rear legs 23, 25 near the handle 27.

A generally U-shaped member 29 for carrying the seat 15 is aligned generally parallel with the floor and affixed to each of the legs.

A seat 15 of plastic or fabric is attached to the U-shaped member 29. Spaces 31 are provided for the child to insert his legs. The seat is low enough to the floor so that the child can reach the floor by standing up.

An enclosure, indicated as numeral 33 in the drawing, is carried by the baby walker. The enclosure, which surrounds the child on the top and on all sides but not the bottom, is formed of a flexible thermo plastic such as polyethalene, that is rigid enough to hold its form, yet flexible enough to be distorted to fit baby walkers of other configurations.

The enclosure 33 is comprised of a plurality of vertical ribs 35 and horizontal ribs 37 intersecting each other in a grid. The ribs curve to a form generally a hemispherical shape with a concave interior. The apertures 39 between the intersections of the ribs 35, 37 are large enough for ease in viewing, yet small enough to prevent the child from extending his arm through. A circular lip 41 forms the edge or bottom perimeter of the enclosure.

Detachable elastic tabs 43 containing snaps 45 loop over the lip 41, and provide means for attaching the enclosure to the frame 13. The tabs 43 may be moved from different apertures 39 about the lip 41 to fit baby walker frames of different configurations. In the baby walker shown in th figure, the lip 41 rests on the portion between the bend designated as 20 and the bend designated as 22 of the legs.

Figure 2:
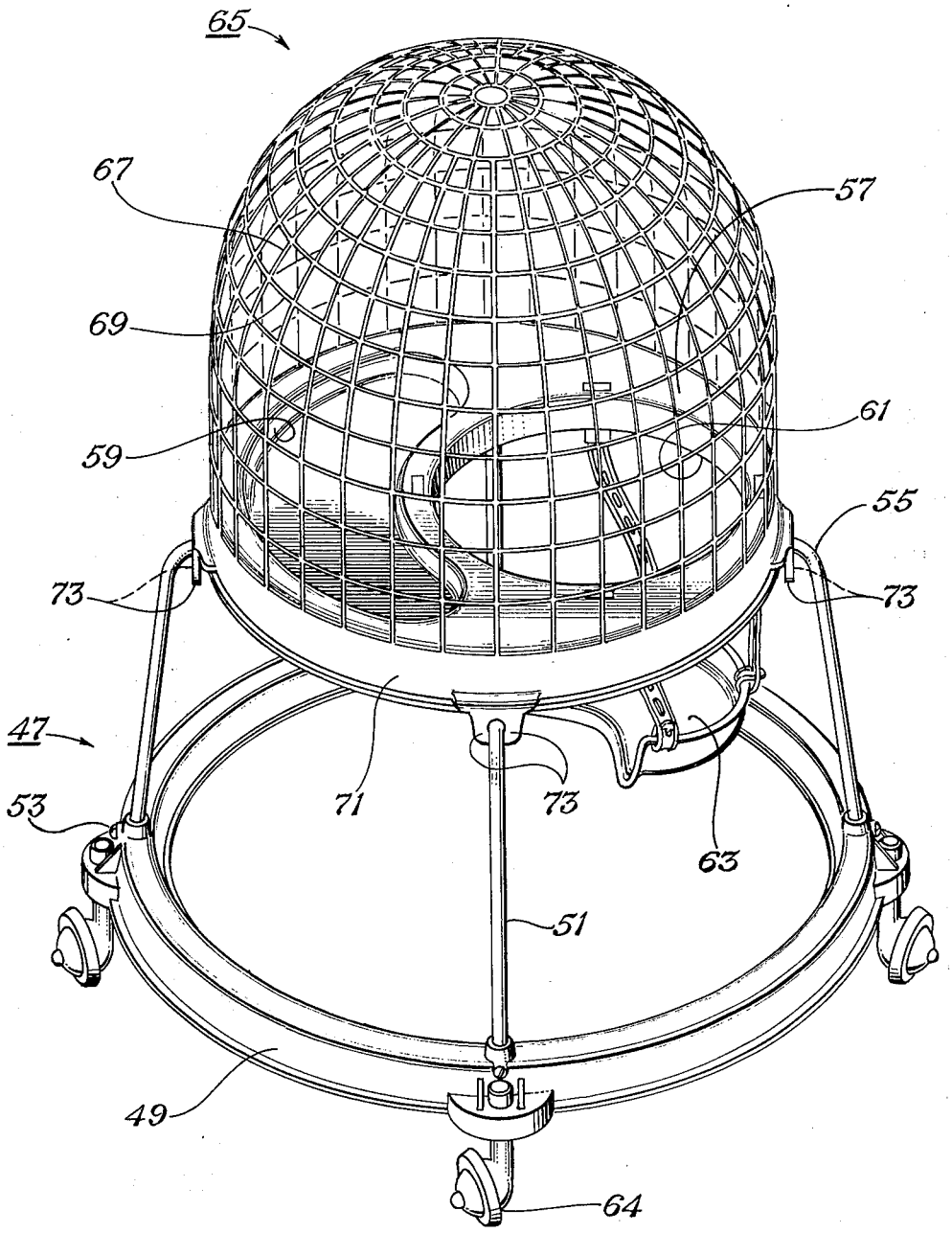
FIG. 2 is a perspective view of an alternate embodiment mounted on another type of baby walker.

FIG. 2 shows an alternate embodiment, particularly for use with a baby walker 47 of circular configuration. Baby walker 47 is comprised of a circular ring 49, often constructed of plastic. Four legs 51, formed of metal rods, are connected to ring 49 by screws 53. Legs 51 extend upwardly, and have a bend 55 adjacent the upper end.

A circular carriage 57 is attached to the four legs 51 parallel to ring 49. Carriage 57 is often constructed of plastic and has a pocket 59 for food dishes and the like, and a hole 61 for the child. A seat 63 is suspended below the hole 61 for a child to sit. Ring 49, legs 51 and carriage 57 comprise the baby walker 47 frame. The frame is mounted on castors 64, attached to ring 49.

An enclosure 65, similar to enclosure 33, is carried by baby walker 47. Like enclosure 33, enclosure 65 is concave and comprised of a plurality of curved vertical ribs 67 and horizontal ribs 69 intersecting each other in a grid. A circular lip 71 forms the edge or bottom perimeter of the enclosure. Enclosure 65 may also be constructed of a flexible thermoplastic.

Enclosure 65 is of less depth than enclosure 33 and fits on bend 55 adjacent carriage 57. The means for attaching the enclosure to the frame are a pair of curved fingers 73 that clip over each leg 51. Fingers 73 curve toward each other in a general C configuration that fits tightly around each leg 51. Fingers 73 are preferably of flexible plastic formed integrally with enclosure 65. Enclosure 65 may be installed simply by pressing downward, forcing fingers 73 in place, and removed by lifting upward.

It is thus seen that an invention having significant improvements has been provided. The enclosure prevents the child from reaching dangerous objects, yet adds no hindrance to the mobility of the walker. It is easily removable to allow the child to be placed in the walker. It is inexpensive to manufacture and adaptable to walkers of various configurations.

Although this invention has been described with a certain degree of particularity, it is understood that the present disclosure has been made only by way of example and that numerous changes in the details of construction and the combination may be resorted to without departing from the spirit or the scope of this invention.

I claim:

1. A device for attachment to a baby walker of the type having a frame mounted on castors and a seat for a child supported by the frame comprising:

an enclosure extending over and around the seat for enclosing the child;

means for attaching the enclosure to the frame;

a plurality of intersecting ribs spaced apart to form a plurality of apertures, the apertures being small enough such that a child may not extend his hand through; and a lip at its bottom perimeter for carrying the attaching means.

2. The device according to claim 1 wherein the attaching means comprises a plurality of detachable elastic tabs encircling the lip for fastening to a portion of the frame.

3. The device according to claim 1 wherein the enclosure is comprised of a flexible plastic so that it may be distorted to fit baby walkers of various sizes and configurations.

4. The device according to claim 1 wherein the enclosure has a concave interior, and the ribs form a grid throughout the enclosure.

5. The device according to claim 1 wherein the attaching means comprises at least one pair of flexible fingers, curved toward each other and formed integrally with the enclosure for clipping over a portion of the frame.

6. The combination of a baby walker having a frame mounted on castors and a seat for a child supported by the frame and an enclosure, the enclosure comprising:

a plurality of intersecting ribs spaced apart to form a plurality of apertures, the apertures being small enough such that a child may not extend his hand through;

means for attaching the enclosure to the frame; and a circular lip at its bottom perimeter for carrying the attaching means.

7. The baby walker according to claim 6 wherein the enclosure has a concave interior and the ribs form a grid throughout the structure defining the enclosure.

8. The baby walker according to claim 6 wherein the enclosure is comprised of a flexible plastic so that it may be distorted to fit baby walkers of various sizes and configurations.

9. The combination comprising:

a baby walker having a frame mounted on castors and a seat for a child supported by the frame; and an enclosure mounted to the frame for enclosing the upper portion of the child, the enclosure containing means for preventing the child from extending his hand through.

* * * * *